US006394697B1

(12) United States Patent
De Boer

(10) Patent No.: US 6,394,697 B1
(45) Date of Patent: May 28, 2002

(54) VIBRATION PLATE WITH A SOLE

(75) Inventor: Nanne De Boer, Rechtsupweg (DE)

(73) Assignee: Wacker-Werke GmbH & Co. KG, Munich (DE)

( * ) Notice: Subject to any disclaimer, the term of this patent is extended or adjusted under 35 U.S.C. 154(b) by 0 days.

(21) Appl. No.: 09/230,215

(22) PCT Filed: Jul. 18, 1997

(86) PCT No.: PCT/EP97/03846

§ 371 (c)(1),
(2), (4) Date: Jul. 18, 2000

(87) PCT Pub. No.: WO98/03735

PCT Pub. Date: Jan. 29, 1998

(30) Foreign Application Priority Data

Feb. 17, 2002 (DE) ..... 196 29 324

(51) Int. Cl.[7] ..... E01C 19/35; E02D 3/074
(52) U.S. Cl. ..... 404/133.1; 404/133.05
(58) Field of Search ..... 404/133.05, 133.1, 404/133.2, 117

(56) References Cited

U.S. PATENT DOCUMENTS

| | | | | |
|---|---|---|---|---|
| 3,802,791 A | * | 4/1974 | Uebel | 404/133.1 |
| 3,832,080 A | * | 8/1974 | Stoecker | 404/133.1 |
| 5,261,762 A | * | 11/1993 | Yamaguchi | 404/133.05 |
| 5,645,370 A | * | 7/1997 | Zuerbes et al. | 404/133.1 |

FOREIGN PATENT DOCUMENTS

| | | | | |
|---|---|---|---|---|
| DE | 31 14947 | | 12/1982 | |
| DE | 3439534 A1 | * | 5/1986 | E02D/3/046 |
| SE | WO 91/17322 | | 11/1991 | |

* cited by examiner

*Primary Examiner*—Thomas B. Will
*Assistant Examiner*—Alexandra K. Pechhold
(74) *Attorney, Agent, or Firm*—Boyle Fredrickson Newholm Stein & Gratz S.C.

(57) ABSTRACT

A vibration plate has a sole element that can be fastened durably and without difficulty by straightforward techniques. This is achieved in that, rather than being fastened on the ground-contact plate or the oscillation generator of the bottom mass, the sole element is fastened on the top mass with the drive motor.

15 Claims, 1 Drawing Sheet

VIBRATION PLATE WITH A SOLE

BACKGROUND OF THE INVENTION

The invention relates to a vibration plate.

In the case of the known vibration plates of this type, the sole element is fastened on the vibrating ground-contact plate. The high accelerations which take place there make it very difficult for the fastening of the sole element on the vibration plate to be configured such that it is of straightforward design, on the one hand, and durable, on the other hand, and it has not been possible hitherto to solve this problem in a fully satisfactory manner. Added to this is the fact that the sole element is forcibly carried along at its fastened end by the vibrating ground-contact plate and consequently, if the underlying surface is dusty, creates a considerable amount of additional dust.

OBJECT AND SUMMARY OF THE INVENTION

The object of the invention is to provide a vibration plate on which it is possible for the sole plate to be fastened durably without difficulty providing a straightforward means and which, in addition, does not, on dusty ground, create a considerable amount of addition dust during operation.

The above object is achieved by providing a vibration plate that includes a ground-contact plate and a top mass which is supported on the ground-contact plate via springs or buffers made of elastic material. The vibration plate also includes an oscillation generator which is provided on the ground-contact plate and which has the ability to automatically advance the vibration plate. The vibration plate additionally includes a releasably fastened sole element which is made of elastic material and which is located beneath the ground-contact plate. The sole element is configured as a loose sole mat, and is fastened on the vibration plate, such that the sole element can be carried along at just one of two end faces of the sole element. The sole element extends transversely with respect to an advancement directions. The sole mat is fastened on the top mass of the vibration plate.

In the case of the vibration plate according to the invention, the sole element is largely free of vibration at its fastened end because the design causes the top mass to remain essentially at rest during operation of the vibration plate. It is therefore also the case that the sole element is subjected to considerably less stressing at its fastened end than in the case of the known vibration plates of the generic type, with the result that there are no problems entailed in fastening durably on the vibration plate by straightforward means. Since, as is not the case with the known vibration plates, the sole element of the vibration plate according to the invention remains virtually at rest in the vertical direction at its fastened end, it is also the case that, on dusty ground, it does not create a considerable amount of additional dust.

BRIEF DESCRIPTION OF THE DRAWINGS

The invention is explained in more detail hereinbelow by way of an exemplary embodiment and with reference to the drawing, in which.

DETAILED DESCRIPTION OF THE PREFERRED EMBODIMENTS

Figure 1:
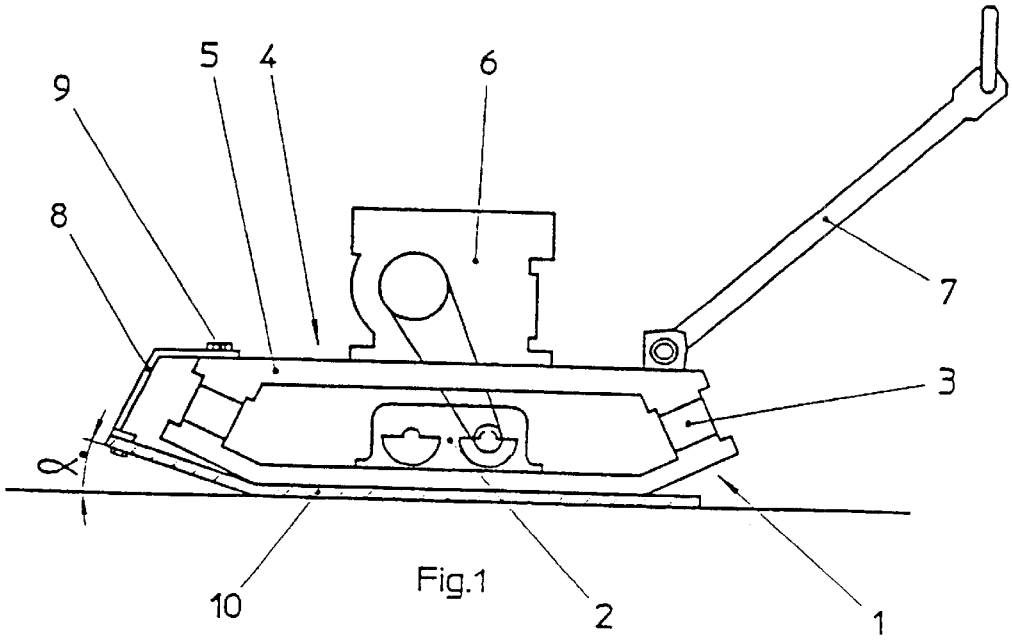
FIG. 1 shows a side view of a preferred embodiment of the vibration plate according to the invention.
Figure 2:
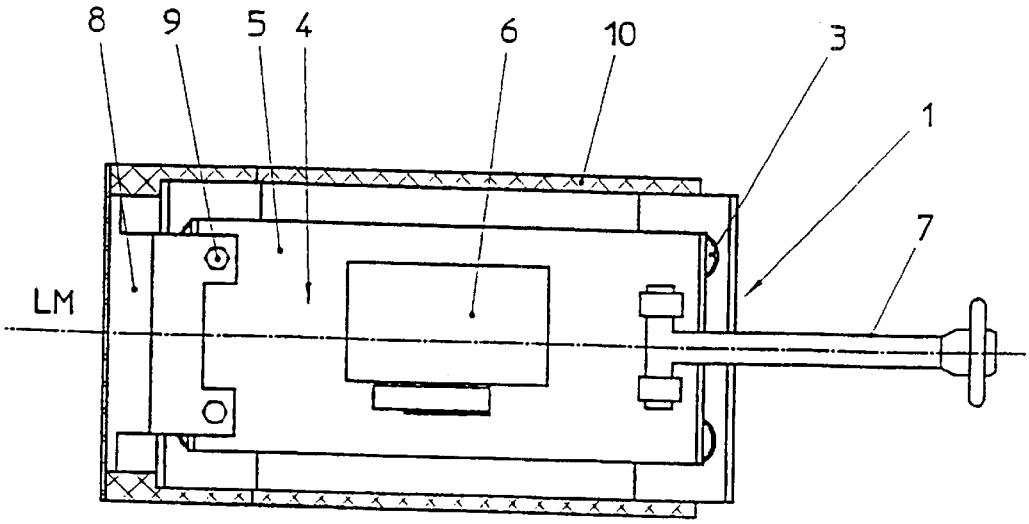
FIG. 2 shows a plan view of the vibration plate according to FIG. 1.

The vibration plate according to FIGS. 1 and 2 has a ground-contact plate 1 on which an oscillation generator 2 is fastened. In the case of the exemplary embodiment, the oscillation generator is a double-shaft oscillation generator with two unbalanced shafts which are arranged parallel to one another and one beside the other in a horizontal plane, extend perpendicular to the advancement direction of the vibration plate and whose mutual phase can be changed under control by the operator, in a manner which is not illustrated specifically, during operation of the generator, such that the vector of the directed oscillation which is generated by said shafts can be changed continuously between a position in which a positive angle is enclosed by the vector and the vertical and a position in which a negative angle is enclosed by the vector and the vertical, with the result that the vibration plate can be operated, as desired, with forward motion, when stationary, and with rearward motion.

It would also be possible to achieve forced forward motion and rearward motion of the vibration plate if use were made, instead of the double-shaft oscillation generator 2, of a single-shaft oscillation generator, a so-called eccentrically loaded rotating shaft, in which the direction of rotation of the unbalanced shaft can be switched over.

Supported on the ground-contact plate 1, via springs 3, e.g. buffers made of elastic material, is a top mass 4, which includes a motor 6, e.g. an internal combustion engine, which is fastened on the frame 5 of the top mass 4 and drives the oscillation generator 2 in a manner which is not illustrated specifically, e.g. via a belt drive.

As the design dictates, the top mass 4 is of a considerably greater weight than the bottom mass, which essentially comprises the ground-contact plate 1 and the oscillation generator 2, and it thus remains virtually at rest in relation to the bottom mass, which vibrates with a considerable amplitude during operation.

The vibration plate according to FIGS. 1 and 2 can be guided manually by means of a control bar 7.

An essentially rigid sole-retaining means 8 is fastened releasably, e.g. screw-connected by screws 9, at one of its ends on that end face of the top mass 4 which is leading when the apparatus is moving forward, and said sole-retaining means extends from the top mass 4, in the vicinity of the ground-contact plate 1, until it is located in front of the latter at the end face. Fastened at this particular end of the sole-retaining means 8 is one end of a sole mat 10 which is made of elastic material and extends from the sole-retaining means 8 beneath the ground-contact plate 1, over the entire length of the latter. The sole mat 10, which, in the case of the exemplary embodiment illustrated, is thus fastened at its end face which is leading when the vibration plate is moving forward, is provided on the sole-retaining means 8 symmetrically with respect to the vertical longitudinal center plane LM of the ground-contact plate 1.

The angle $\alpha$ at which the sole mat 10 extends beneath the ground-contact plate 1 from the point at which it is fastened on the sole-retaining means 8 is selected as a function of the material properties, for example the modulus of elasticity and the thickness, such that the sole mat 10 is also carried along with a pushing action in the advancement direction of the vibration plate, i.e. in this case when the latter is moving rearward, and thus remains in the stretched-out position beneath the ground-contact plate 1.

What is claimed is:

1. Vibration plate comprising:

a ground-contact plate and a top mass which is supported on the ground-contact plate via springs or buffers made of elastic material, an oscillation generator which is provided on the ground-contact plate and which has the ability to automatically advance the vibration plate in an advancement direction, and a releasably fastened sole element which is made of an elastic material, which is located beneath the ground-contact plate, which is configured as a loose sole mat, which is fastened on the vibration plate such that the sole mat can be carried along on the ground compacting plate at just one of two end faces of the sole mat, and which extends transversely with respect to the advancement direction, wherein the sole mat is fastened on the top mass of the vibration plate.

2. Vibration plate according to claim 1, further comprising a rigid sole-retainer which is releasably fastened on the top mass, which extends from the top mass in the vicinity of the ground-contact plate until the sole-retainer is located in front of the ground contact plate at an end face of the sole-retainer, and on which the sole mat is fastened.

3. Vibration plate according to claim 2, wherein the sole mat is fastened on the sole-retainer symmetrically with respect to a vertical longitudinal center plate of the ground-contact plate.

4. Vibration plate according to claim 1, wherein the sole mat is fastened at an end face thereof which is leading when the vibration plate is moving forward.

5. Vibration plate according to claim 1, wherein the sole mat is fastened at an end face thereof which is trailing when the vibration plate is moving forward.

6. A vibration plate comprising:

a ground-contact plate;

a top mass which is supported on the ground-contact plate via springs or buffers made of elastic material;

an oscillation generator which is supported on the ground-contact plate and which has the ability to automatically advance the vibration plate in an advancement direction; and a sole mat which is made of an elastic material, which is located beneath the ground-contact plate, which has two ends that extend transversely with respect to the advancement direction, and which is releasably fastened on the top mass of the vibration plate at only one of the two ends of the sole mat.

7. A vibration plate according to claim 6, further comprising a rigid sole-retainer to which the one end of the sole mat is fastened, which is releasably fastened on the top mass, and which extends from the top mass to a location in front of the ground contact plate.

8. A vibration plate according to claim 7, wherein the ground-contact plate has a vertical longitudinal center plate, and wherein the sole mat is fastened on the sole-retainer symmetrically with respect to the vertical longitudinal center plate.

9. A vibration plate according to claim 6, wherein the sole mat is fastened to the top mass at an end of the sole mat which is leading when the vibration plate is moving forward.

10. A vibration plate according to claim 6, wherein the sole mat is fastened to the top mass at an end of the sole mat which is trailing when the vibration plate is moving forward.

11. A vibration plate comprising:

a ground-contact plate;

a top mass which is supported on the ground-contact plate via springs or buffers made of elastic material;

an oscillation generator which is provided on the ground-contact plate and which has the ability to automatically advance the vibration plate in an advancement direction;

an engine which is supported on the top mass and which drives the oscillation generator;

a frame which is supported on the top mass and which supports the engine;

a guide handle which is supported on the top mass and which can be manipulated by an operator to guide the vibration plate; and a sole element which is made of an elastic material, which is located beneath the ground-contact plate, which has two ends that extend transversely relative to the advancement direction, which is fastened on the top mass at only of the ends thereof so as to be configured as a loose sole mat that can be carried along on the vibration plate at just one of the two ends of the sole mat.

12. A vibration plate according to claim 11, further comprising a rigid sole-retainer to which the one end of the sole mat is fastened, which is releasably fastened on the top mass, and which extends from the top mass to a location in front of the ground contact plate.

13. Vibration plate according to claim 12, wherein ground-contact plate has a vertical longitudinal center plate, and wherein the sole mat is fastened on the sole-retainer symmetrically with respect to the vertical longitudinal center plate.

14. Vibration plate according to claim 11, wherein the sole mat is fastened to the top mass at an end of the sole mat which is leading when the vibration plate is moving forward.

15. A vibration plate according to claim 11, wherein the sole mat is fastened to the top mass at an end of the sole mat which is trailing when the vibration plate is moving forward.

* * * * *